US005564441A

United States Patent [19]

Sharp et al.

[11] Patent Number: 5,564,441

[45] Date of Patent: Oct. 15, 1996

[54] PNEUMATIC WEB FEEDING

[75] Inventors: Norman L. Sharp; Robert E. Williams, both of High Wycombe, Great Britain

[73] Assignee: Molins PLC, Milton Keynes, England

[21] Appl. No.: 299,631

[22] Filed: Sep. 2, 1994

[30] Foreign Application Priority Data

Sep. 2, 1993 [GB] United Kingdom ..... 9318194

[51] Int. Cl.[6] ..... A24C 5/14; A24C 5/20

[52] U.S. Cl. ..... 131/84.1; 131/60; 406/88

[58] Field of Search ..... 131/60, 84.1; 226/97, 226/7, 196; 406/86, 88, 93

[56] References Cited

U.S. PATENT DOCUMENTS

| | | | |
|---|---|---|---|
| 3,705,676 | 12/1972 | Overly et al. . | |
| 4,135,767 | 1/1979 | Hench et al. | 406/88 |
| 4,913,329 | 4/1990 | Cahill et al. . | |
| 5,203,485 | 4/1993 | Cahill et al. . | |

FOREIGN PATENT DOCUMENTS

| | | |
|---|---|---|
| 2138799 | 1/1973 | France . |
| 2649683 | 1/1991 | France . |
| 1379260 | 1/1975 | United Kingdom . |
| 1556586 | 11/1979 | United Kingdom . |
| 2075455A | 11/1981 | United Kingdom . |

*Primary Examiner*—Jennifer Bahr
*Attorney, Agent, or Firm*—Antonelli, Terry, Stout & Kraus

[57] ABSTRACT

Apparatus for conveying a paper web or other sheet material pneumatically along a predetermined path comprises two guide plates 20, 22 having outer surfaces defining successive parts of the path and having adjacent edges which are inclined to the outer surfaces and are spaced apart so as to form a slot 28 inclined to the outer surfaces of the plates, and including an air pressure manifold 26 which is secured to both guide plates and from which an air stream is arranged to be emitted through the slot to produce an air stream which will move along one of the plates 22 which is downstream of the other plate with respect to the intended direction of conveyance of the web or other sheet material. When applied to a cigarette making machine, apparatus of this general type may be used at various positions for feeding the paper web through the printer, and also to feed the web automatically all the way into the garniture 12.

10 Claims, 1 Drawing Sheet

PNEUMATIC WEB FEEDING

This invention is concerned particularly with feeding the paper web in a cigarette making machine, but it is applicable to the feeding of other webs and other forms of sheet material. Earlier proposals which we have made are described in our U.S. Pat. Nos. 4,913,329 and 5,203,485.

According to one aspect of this invention, apparatus for conveying a paper web or other sheet material pneumatically along a predetermined path comprises two guide plates having outer surfaces defining successive parts of the path and having adjacent edges which are inclined to the outer surfaces and are spaced apart from one another so as to form a slot inclined to the outer surfaces of the plates, and including an air pressure manifold which is secured to or adjacent to both guide plates and from which an air stream is arranged to be emitted through the slot to produce an air stream which will move along one of the plates which is downstream of the other plate with respect to the intended direction of conveyance of the web or other sheet material.

The edges of the guide plates may be spaced apart to the desired extent during assembly of the apparatus, for example with the aid of a gauge. However, in a preferred construction one of the guide plate edges is formed with a recessed central portion which cooperates with the edge of the other guide plate to define the slot, the outer portions of the first guide plate being arranged to engage the edge of the other plate so as both to define the "thickness" of the slot and preferably also to form side air seals in cooperation with the other guide plate preventing or restricting a lateral escape of air.

The manifold may comprise a hollow body closed on one side by the guide plates.

A complete apparatus according to this invention may comprise a succession of guide plates having inclined adjoining edges and corresponding air pressure manifolds as described above.

Another aspect of this invention is specifically concerned with the conveyance of paper web in a cigarette making machine to form the wrapper of the cigarette rod. A prior proposal for this purpose, especially concerned with threading the paper pneumatically through the printer of a cigarette making machine, is described in our U.S. Pat. No. 4,913,329. According to the this second aspect of the present invention, apparatus for conveying the paper web pneumatically, for example in accordance with the first aspect of this invention, is provided for conveying the paper web substantially horizontally onto the garniture tape of the machine by which the paper web is wrapped around a cigarette filler stream to form a continuous cigarette rod.

An example of apparatus according to this invention used to feed the paper web in a cigarette making machine is shown in the accompanying drawings. In these drawings.

Figure 1:
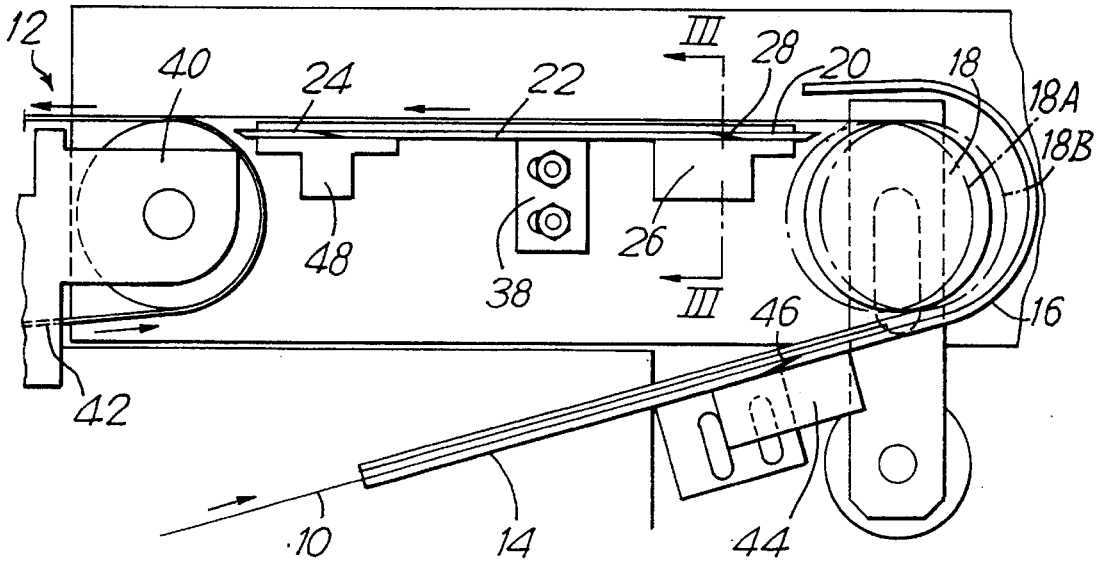
FIG. 1 is a front view showing the last stage of the paper web feed into the garniture of the cigarette making machine.

FIG. 1 shows the paper web 10 after it has passed through a printer and as it approaches the final stage of its conveyance towards a garniture 12 which may be of conventional construction (details being omitted here), including a garniture tape 42. The web 10 is shown in FIG. 1 as it moves firstly along a guide plate 14 which is followed by a plate 16 bent around a final pulley 18, the curved part of the plate 16 being spaced from the periphery of the pulley and being arranged to deliver the paper onto a further guide plate 20.

This plate 20 is followed by plates 22 and 24 which, when the machine is started, feed the paper web horizontally onto the garniture tape 42.

Conveyance of the paper web along the plate 22 is achieved by a stream of air flowing along the upper surface of the plate 22. This air stream is emitted from a manifold 26 via an inclined slot between the upstream edge of the plate 22 and the adjacent downstream edge of the plate 20. The slot 28 is shown more clearly in FIG. 2, where the lower end 28A of the slot is shown in dotted outline. The slot is inclined to the upper surfaces of the plates 20 and 22 by an angle of approximately 10°. Its thickness (i.e. the spacing between the inclined edges of the plates) is approximately 0.2 mm.

Figure 2:
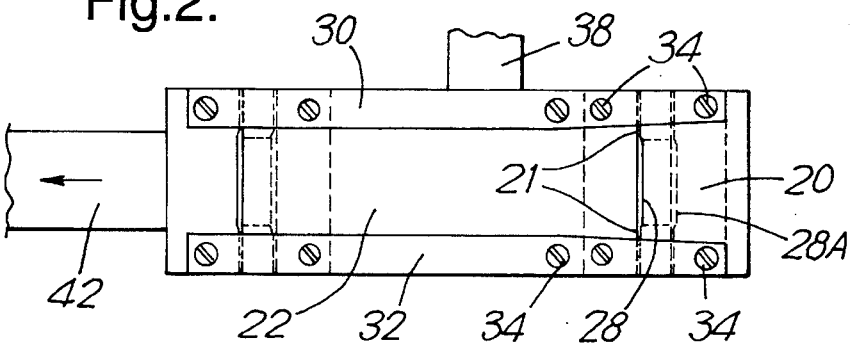
FIG. 2 is a plan view of part of the web guide apparatus shown in FIG. 1.

The manifold 26 is secured to the guide plates 20 and 22, and also to side guide strips 30 and 32, by screws 34. As shown in FIG. 2, the slot 28 exists by virtue of the central portion of the downstream edge of the plate 20 being recessed, leaving side portions 21 of the plate 20 to engage the inclined edge of the plate 22 and thus define the thickness of the slot. These engaging side portions of the plate 20 also seal against the edge of the plate 22 to prevent a lateral escape of air. It will be seen that the slot 28 has a width which is slightly less than the spacing between the inner edges of the side strips 30 and 32, which are additionally flared at their entry end.

Figure 3:
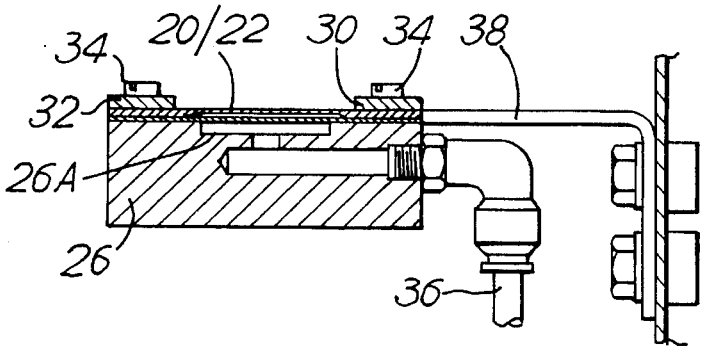
FIG. 3 is a section on the line III—III in FIG. 1.

The manifold 26 is shown more particularly in FIG. 3. It has an upper recess 26A forming a space for pressure air supplied from a pipe 36. The top of the recess 26A is closed by the plates 20 and 22. The position of the section represented by FIG. 3 is such that part of the thickness of each plate is shown; a space between them (not clearly shown on this scale) represents the slot 28.

The plates and the manifold are carried by a bracket 38. It should be noted, as shown in FIG. 1, that the normal running position of the paper web 10, which is tangential to the pulley 18 and to a pulley 40 for the garniture tape 42, lies slightly above the top surfaces of the side guides 30 and 32.

During use, when the paper web is being threaded pneumatically through the printer and into the garniture, after emerging from the printer it is conveyed pneumatically along the plate 14 (by means not shown) and is then conveyed pneumatically along the plate 16 by means of an air stream produced by a manifold 44 from which air passes through an inclined slot 46 in the manner described above with reference to the slot 28. The air stream emitted from the slot 46 conveys the paper along the inside surface of the curved portion of the plate 16, and the paper is then deposited on the plate 20. After it has passed along the plate 22, the paper is conveyed further by an air stream produced by a manifold 48 secured to the downstream end of the plate 22 and to a short final plate 24. As the paper is released by appropriate rotation of the paper reel or by feed rollers (not shown) it can be dragged forward by the garniture tape 42. Once it has entered the garniture to commence normal operation, the supply of air to the various manifolds is switched off.

FIG. 1 shows the pulley 18 in solid outline and in two broken outlines 18A and 18B which represent a range of movement for adjusting the print position on the cigarettes. It will be seen that pneumatic conveyance of the paper around the pulley 18, along the curved portion of the plate 16, is unaffected by adjustment of the pulley position.

FIG. 2 shows a portion of the paper web 42 and it should be noted that the spacing between the inner edges of the side strips 30 and 32, between which the web is conveyed while it is being initially passed to the garniture, is only slightly greater than the width of the web.

We claim:

1. Apparatus for conveying a paper web or other sheet material pneumatically along a predetermined path comprising two guide plates having outer surfaces defining successive parts of the path and having adjacent edges which are inclined to the outer surfaces and are spaced apart from one another so as to form a slot inclined to the outer surfaces of the plates, and including an air pressure manifold which is secured to or adjacent to both guide plates and from which an air stream is arranged to be emitted through the slot to produce an air stream which will move along one of the plates which is downstream of the other plate with respect to the intended direction of conveyance of the web or other sheet material, in which one of the guide plate edges is formed with a recessed central portion which cooperates with the edge of the other guide plate to define the slot, outer portions of the first guide plate being arranged to engage the edge of the other plate so as to define the thickness of the slot and also to form side air seals in cooperation with the other guide plate.

2. Apparatus according to claim 1, in which the angle of inclination of the slot to the outer surfaces of the plates is approximately 10 degrees.

3. Apparatus according to claim 1, in which the thickness of the slot is approximately 0.2 mm.

4. Apparatus according to claim 1, including side guide strips extending along the side edges of at least the downstream guide plate for preventing a lateral escape of air and for guiding the paper web against lateral displacement.

5. A cigarette making machine, including a garniture tape by which a continuous paper web is wrapped around a tobacco filler stream to form a cigarette rod, and means for conveying the paper web pneumatically in a substantially horizontal direction onto the garniture tape when the machine is started up, in which the pneumatic feed for the paper web comprises or includes two guide plates having outer surfaces defining successive parts of the path and having adjacent edges which are inclined to the outer surfaces and are spaced apart from one another so as to form a slot inclined to the outer surfaces of the plates, and including an air pressure manifold which is secured to or adjacent to both guide plates and from which an air stream is arranged to be emitted through the slot to produce an air stream which will move along one of the plates which is downstream of the other plate with respect to the intended direction of conveyance of the web or other sheet material.

6. A cigarette making machine including a garniture tape by which a continuous paper web is wrapped around a tobacco filler stream to form a cigarette rod, and means for conveying the paper web pneumatically in a substantially horizontal direction onto the garniture tape when the machine is started up, in which the paper web is arranged to be fed from a reel and in which, while the machine is being started and the web is being fed pneumatically towards the garniture tape, the machine is arranged to run slowly so that the garniture tape runs at approximately the same speed as the pneumatically advancing web.

7. A machine including a device through which a continuous paper web passes along a predetermined path, and means for conveying the paper web pneumatically in a substantially horizontal direction into said device when the machine is started up, said pneumatic conveying means comprising two guide plates having outer surfaces defining successive parts of the path and having adjacent edges which are inclined to the outer surfaces and are spaced apart from one another so as to form a slot inclined to the outer surfaces of the plates, and including an air pressure manifold which is secured to or adjacent to both guide plates and from which an air stream is arranged to be emitted through the slot to produce an air stream which will move along one of the plates which is downstream of the other plate with respect to the intended direction of conveyance of the web or other sheet material, in which one of the guide plate edges is formed with a recessed central portion which cooperates with the edge of the other guide plate to define the slot, outer portions of the first guide plate being arranged to engage the edge of the other plate so as to define the thickness of the slot and also to form side air seals in cooperation with the other guide plate.

8. Apparatus according to claim 7, in which the angle of inclination of the slot to the outer surfaces of the plates is approximately 10 degrees.

9. Apparatus according to claim 7, in which the thickness of the slot is approximately 0.2 mm.

10. Apparatus according to claim 7, including side guide strips extending along the side edges of at least the downstream guide plate for preventing a lateral escape of air and for guiding the paper web against lateral displacement.

* * * * *